US011808111B2

(12) United States Patent
Chambers

(10) Patent No.: US 11,808,111 B2
(45) Date of Patent: Nov. 7, 2023

(54) ROTATING CONTROL DEVICE WITH INTEGRATED COOLING FOR SEALED BEARINGS

(71) Applicant: WEATHERFORD TECHNOLOGY HOLDINGS, LLC, Houston, TX (US)

(72) Inventor: James W. Chambers, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 17/670,144

(22) Filed: Feb. 11, 2022

(65) Prior Publication Data

US 2023/0258056 A1 Aug. 17, 2023

(51) Int. Cl.
*E21B 36/00* (2006.01)
*E21B 33/08* (2006.01)

(52) U.S. Cl.
CPC ..... *E21B 36/001* (2013.01); *E21B 33/085* (2013.01)

(58) Field of Classification Search
CPC ..... E21B 36/001; E21B 33/085
See application file for complete search history.

(56) References Cited

U.S. PATENT DOCUMENTS 2,904,357 A * 9/1959 Knox ..... F16L 27/0828 384/368
4,383,577 A 5/1983 Pruitt
5,305,839 A 4/1994 Kalsi et al.
5,485,889 A * 1/1996 Gray ..... E21B 7/068 175/73
6,225,720 B1 5/2001 Desta
6,761,544 B2 7/2004 McCartney
7,004,444 B2 2/2006 Kinder
7,891,426 B2 2/2011 Williams
3,500,337 A1 8/2013 Beauchamp et al.
8,714,240 B2 * 5/2014 Bailey ..... E21B 36/001 166/84.2

(Continued)

FOREIGN PATENT DOCUMENTS

WO 2004114498 A2 12/2004
WO 2015168429 A2 11/2015

(Continued)

OTHER PUBLICATIONS

International Search Report with Written Opinion dated Jan. 31, 2023 for PCT patent application No. PCT/IB2022/062166, 13 pages.

*Primary Examiner* — Jonathan Malikasim
(74) *Attorney, Agent, or Firm* — Smith IP Services, P.C.

(57) ABSTRACT

A pressure control device can include an outer housing, a bearing assembly with bearings to rotatably support an inner barrel in the outer housing, a heat exchanger, and fluid passages that communicate between the bearings and the heat exchanger, and a latch assembly configured to releasably secure the bearing assembly in the outer housing. The latch assembly can include a heat exchanger configured to exchange heat with the bearing assembly heat exchanger. Another pressure control device can include a bearing assembly with bearings to rotatably support an inner barrel in the outer housing, fluid passages that communicate with space adjacent the bearings, a pump in communication with the fluid passages, and a gear train connected between the pump and a ring gear secured to the inner barrel.

17 Claims, 7 Drawing Sheets

(56) References Cited

U.S. PATENT DOCUMENTS

| | | | |
|---|---|---|---|
| 8,770,297 | B2 | 7/2014 | Bailey et al. |
| 9,284,811 | B2 | 3/2016 | Michaud et al. |
| 9,334,711 | B2 | 5/2016 | Hannegan et al. |
| 9,359,853 | B2 | 6/2016 | Nas et al. |
| 9,784,073 | B2 | 10/2017 | Bailey et al. |
| 10,156,117 | B2 | 12/2018 | Dewesee, Jr. |
| 2007/0199691 | A1 | 8/2007 | Heller et al. |
| 2015/0315874 | A1* | 11/2015 | Chambers ..... E21B 36/001 166/57 |
| 2015/0376972 | A1 | 12/2015 | Lock |
| 2016/0168911 | A1 | 6/2016 | Karigan |
| 2019/0162041 | A1 | 5/2019 | Patel |
| 2020/0340326 | A1 | 10/2020 | Leuchtenberg et al. |

FOREIGN PATENT DOCUMENTS

| | | | |
|---|---|---|---|
| WO | 2017074647 | A1 | 5/2017 |
| WO | 2019108317 | A1 | 6/2019 |

* cited by examiner

ROTATING CONTROL DEVICE WITH INTEGRATED COOLING FOR SEALED BEARINGS

BACKGROUND

This disclosure relates generally to equipment utilized and operations performed in conjunction with a subterranean well and, in an example described below, more particularly provides a rotating control device with sealed bearings and integrated cooling and lubrication therefor.

A rotating control device (RCD, also sometimes referred to as a rotary control head or rotary diverter) can be used to seal off an annulus formed radially between an outer housing and a tubular member that rotates in the outer housing. An annular seal element of the RCD seals against an outer surface of the rotating tubular member. If the seal element rotates with the tubular member, then the seal element is typically mounted with bearings in the outer housing.

Therefore, it will be appreciated that improvements are continually needed in the art of designing, constructing and utilizing rotating control devices. It is among the objects of the present disclosure to provide such improvements to the art. The improvements may be used with a wide variety of different well and well equipment configurations.

DETAILED DESCRIPTION

Figure 1:
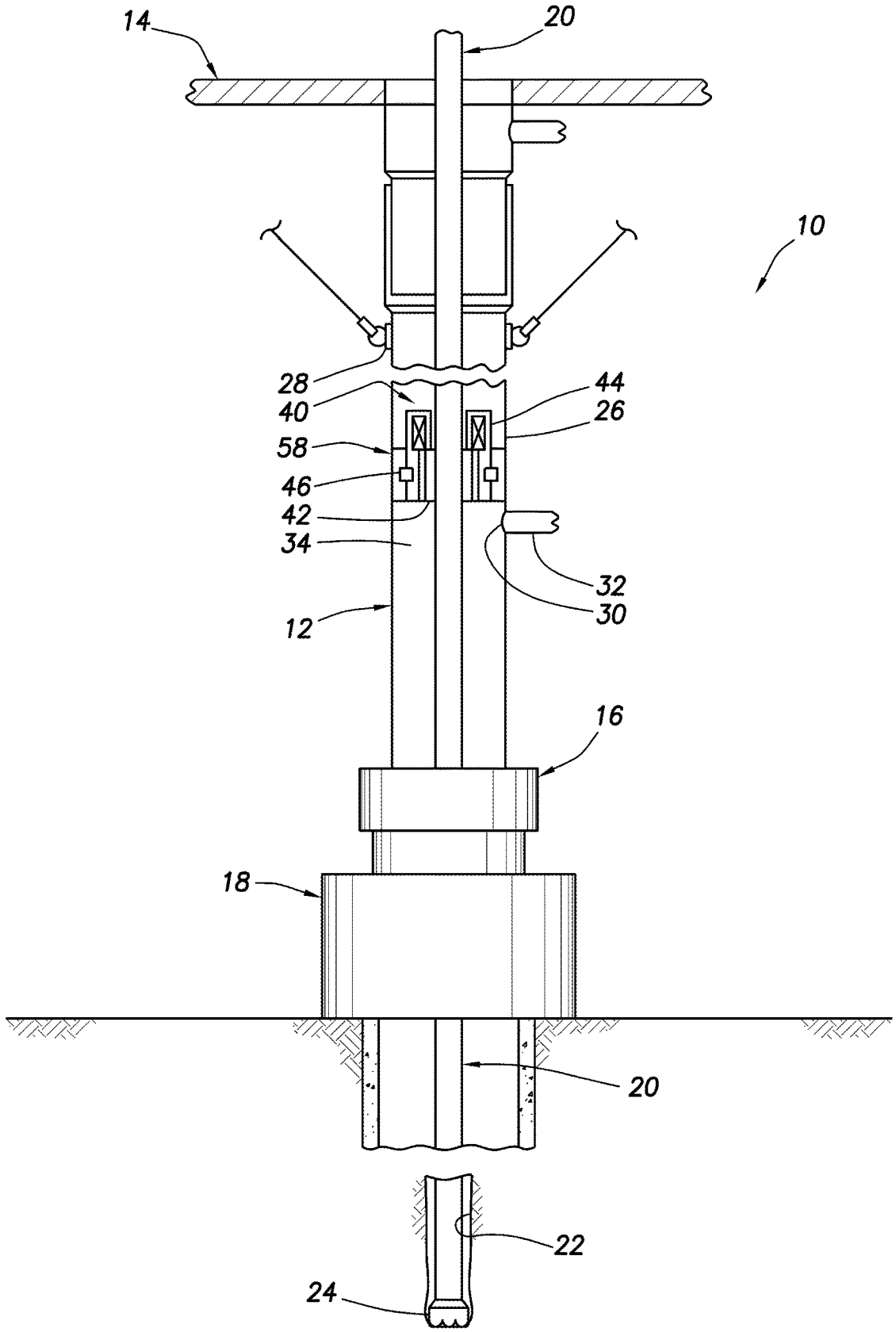
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method as described herein and/or depicted in the drawings.

In the system 10 as depicted in FIG. 1, a generally tubular riser string 12 extends between a water-based rig 14 and a lower marine riser package 16 above a subsea wellhead installation 18 (including, for example, various blowout preventers, hangers, fluid connections, etc.). However, in other examples, the principles of this disclosure could be practiced with a land-based rig, or with a riser-less installation.

In the FIG. 1 example, a tubular string 20 (such as, a jointed or continuous drill string, a coiled tubing string, etc.) extends through the riser string 12 and is used to drill a wellbore 22 into the earth. For this purpose, a drill bit 24 is connected at a lower or distal end of the tubular string 20.

The drill bit 24 may be rotated by rotating the tubular string 20 (for example, using a top drive or rotary table of the rig 14), and/or a drilling motor (not shown) may be connected in the tubular string 20 above the drill bit 24. However, the principles of this disclosure could be utilized in well operations other than drilling operations. Thus, it should be appreciated that the scope of this disclosure is not limited to any of the details of the tubular string 20 or wellbore 22 as depicted in the drawings or as described herein.

The riser string 12 depicted in FIG. 1 includes an outer housing assembly 26 connected in the riser string 12 below a tensioner ring 28 suspended from the rig 14. In other examples, the outer housing assembly 26 could be connected above the tensioner ring 28, or could be otherwise positioned (such as, in the wellhead installation 18 in a riser-less configuration). Thus, the scope of this disclosure is not limited to any particular details of the riser string 12 or outer housing assembly 26 as described herein or depicted in the drawings.

The outer housing assembly 26 includes a side port 30 that provides for fluid communication between a conduit 32 and an annulus 34 formed radially between the riser string 12 and the tubular string 20. In a typical drilling operation, drilling fluid can be circulated from the rig 14 downward through the tubular string 20, outward from the drill bit 24, upward through the annulus 34, and return to the rig 14 via the conduit 32.

As depicted in FIG. 1, a rotating control device 40 is installed in the outer housing assembly 26. The rotating control device 40 and the outer housing assembly 26 comprise a pressure control device 58.

In the FIG. 1 example, the rotating control device 40 includes one or more annular seals 42 that seal off the annulus 34 above the side port 30. In this example, the annular seals 42 are configured to sealingly engage an exterior of the tubular string 20. The annular seals 42 may be of a type known to those skilled in the art as "passive," "active" or a combination of passive and active. The scope of this disclosure is not limited to use of any particular type of annular seal.

Rotation of the annular seals 42 relative to the outer housing assembly 26 is provided for by bearings 44 of the rotating control device 40. The annular seals 42 and bearings 44 are releasably secured in the outer housing assembly 26 by a latch assembly 46. The latch assembly 46 permits the annular seals 42 and/or the bearings 44 to be installed in, or retrieved from, the outer housing assembly 26 when desired, for example, to service or replace the seals 42 and/or bearings 44.

Various components of the latch assembly 46 may be part of, or integral to, the outer housing assembly 26, the rotating control device 40, or a combination thereof. The scope of this disclosure is not limited to any particular location(s) or configuration of any components or combination of components of the latch assembly 46.

Figure 2:
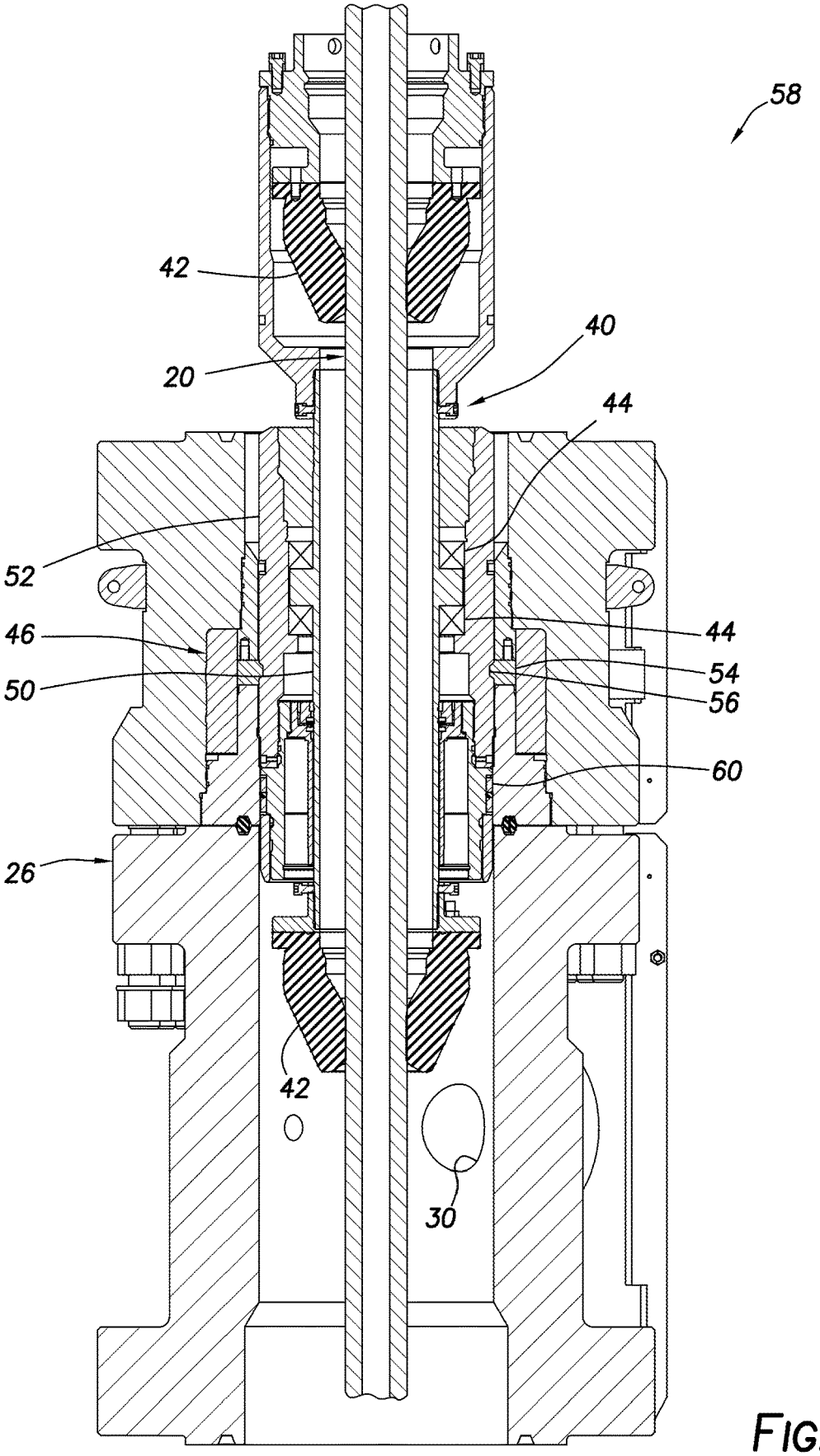
FIG. 2 is a representative cross-sectional view of an example of a rotating control device that may be used in the FIG. 1 system and method, and which can incorporate the principles of this disclosure.

Referring additionally now to FIG. 2, a more detailed cross-sectional view of an example of the pressure control device 58 is representatively illustrated. The FIG. 2 pressure control device 58 can be configured to incorporate the principles of this disclosure. The pressure control device 58 is described below as it may be used in the system 10 and method of FIG. 1, but it should be clearly understood that the pressure control device may be used in a variety of different systems and methods, in keeping with the principles of this disclosure.

In the FIG. 2 example, the rotating control device 40 includes two of the annular seals 42 for sealingly engaging the tubular string 20. The annular seals 42 are connected to, and rotate with, an inner barrel 50. In this manner, the annular seals 42 can rotate with the tubular string 20 while sealingly engaging the tubular string.

The inner barrel 50 is rotatably supported by the bearings 44 relative to an outer barrel 52. To secure the rotating control device 40 to the housing assembly 26, a latch member 54 of the latch assembly 46 is displaced radially inward into engagement with an annular recess 56 on the outer barrel 52. The latch assembly 46 may be hydraulically, pneumatically, electrically or otherwise actuated to displace the latch member 54. To release the rotating control device 40 for retrieval from the housing assembly 26, the latch assembly 46 is actuated to displace the latch member 54 radially outward and disengaged from the recess 56.

An annular seal assembly 60 is carried on the rotating control device 40 for sealing between the rotating control device and the housing assembly 26. In this example, the annular seal assembly 60 is sealingly engaged about the rotating control device 40 and, when the rotating control device is installed in the housing assembly 26, the annular seal assembly is sealingly engaged in the housing assembly.

Figure 3:
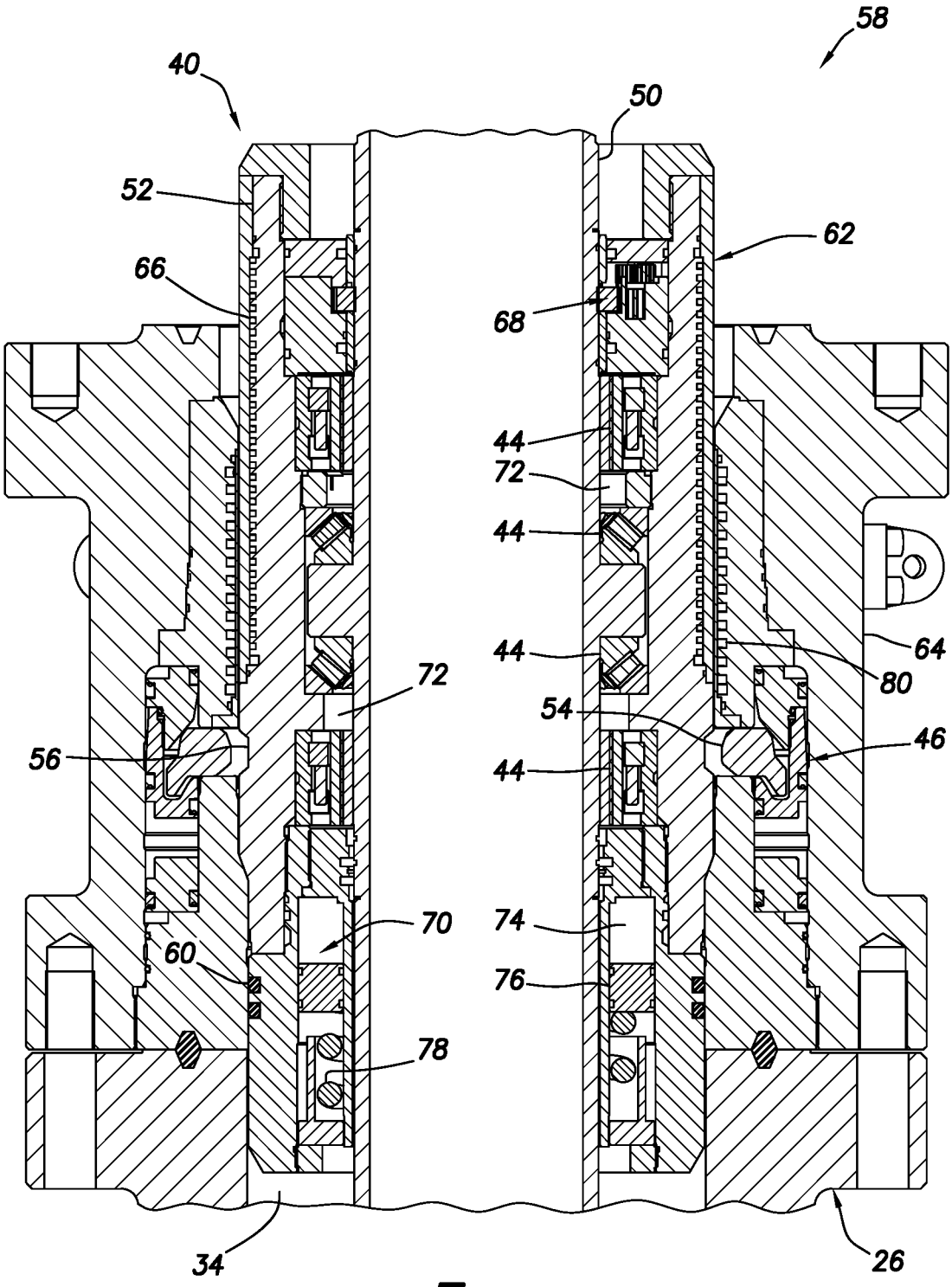
FIG. 3 is a representative cross-sectional view of another example of the rotating control device that embodies the principles of this disclosure.

Referring additionally now to FIG. 3, a cross-sectional view of another example of a pressure control device 58 is representatively illustrated. The annular seals 42 connected at opposite ends of the inner barrel 50 are not shown in FIG. 3. However, it will be understood that the pressure control device 58 having the annular seals 42 connected to the inner barrel 50 will cause the inner barrel to rotate if the tubular string 20 (see FIG. 2) rotates therein, due to friction between the annular seals and the outer surface of the tubular string.

In the FIG. 3 example, the bearings 44 are contained in a bearing assembly 62 that can be releasably secured in an outer housing 64 by the latch assembly 46. The bearing assembly 62 includes the bearings 44, the inner and outer barrels 50, 52, a heat exchanger 66, a pump assembly 68 and a pressure compensator 70.

The pressure compensator 70 isolates a lubricant-filled space 72 about the bearings 44 from well fluids in the annulus 34. The pressure compensator 70 also ensures that the lubricant-filled space 72 is maintained at a pressure somewhat greater than a pressure in the annulus 34. An annular chamber 74 above a floating annular piston 76 is in communication with the space 72. Pressure in the chamber 74 is elevated relative to pressure in the annulus 34, due to a force exerted on the piston 76 by a biasing device 78.

A pump (not visible in FIG. 3, see FIG. 5) of the pump assembly 68 pumps a fluid, such as a lubricant, through the bearings 44, the space 72 and the heat exchanger 66. In operation, heat is generated in the bearings 44 as the inner barrel 50 rotates. The heat is transferred to the lubricant, and the lubricant is flowed to the heat exchanger 66 by the pump.

The heat exchanger 66 is appropriately positioned in the bearing assembly 62, so that it is capable of transferring the heat to another heat exchanger 80 of the latch assembly 46. In operation, the heat is transferred from the heat exchanger 66 to the latch assembly heat exchanger 80. The latch assembly heat exchanger 80 is connected to an external hydraulic power unit via passages formed in the outer housing 64 and in communication with the heat exchanger. The external hydraulic power unit includes another heat exchanger for dissipating the heat external to the pressure control device 58.

The heat exchangers 66, 80, pump assembly 68 and external hydraulic power unit may be used with the FIG. 2 pressure control device 58. In this manner, a temperature of the bearings 44 in operation can be reduced and the bearings can be maintained in a sealed and lubricated environment.

Figure 4:
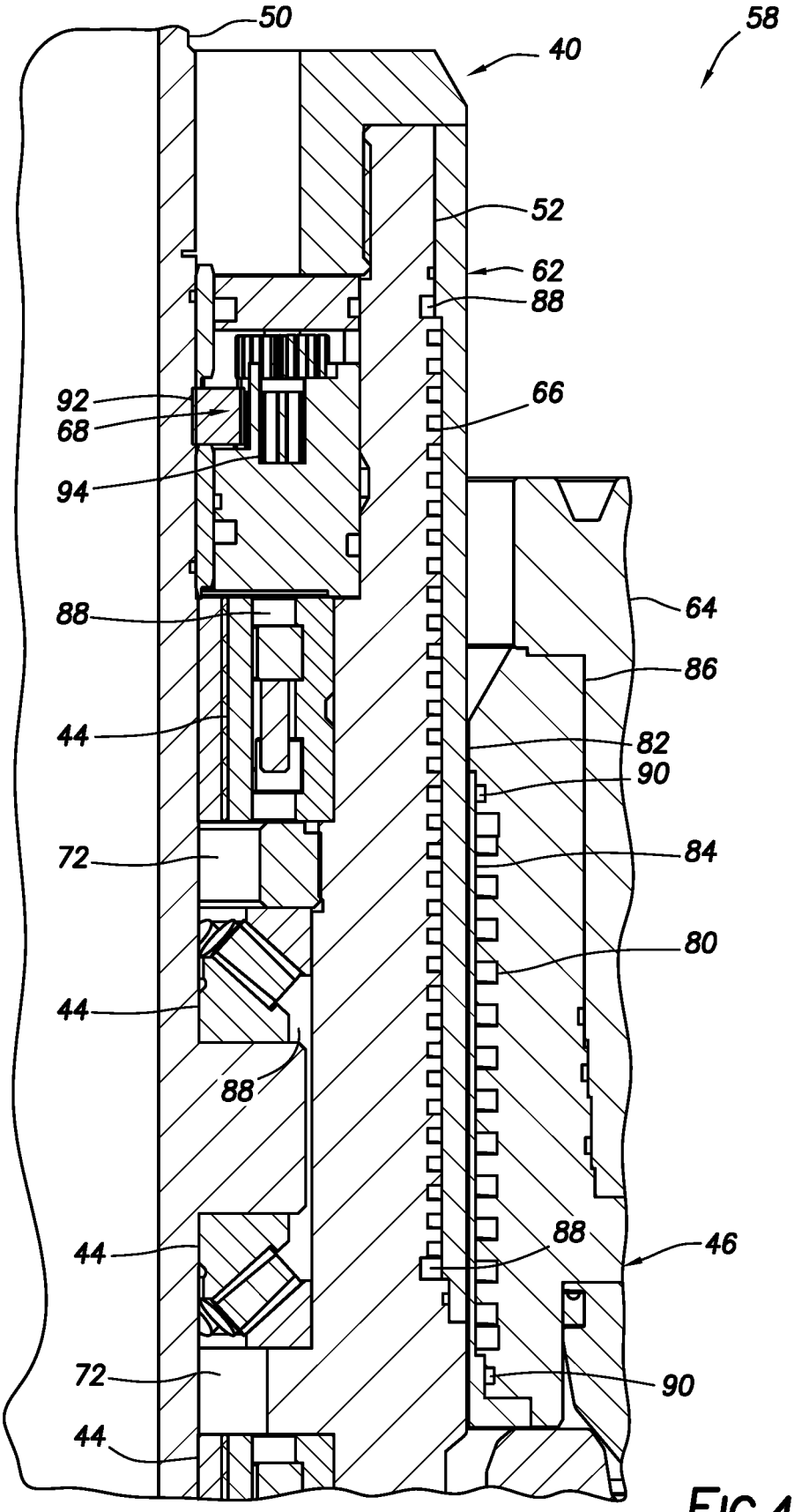
FIG. 4 is a representative cross-sectional view of a heat exchanger section of the FIG. 3 rotating control device.

Referring additionally now to FIG. 4, a cross-sectional view of a heat exchanger section of the pressure control device 58 is representatively illustrated. In this view it can be more clearly seen that each of the heat exchangers 66, 80 comprises a helically formed recess overlaid by a respective thermally conductive sleeve 82, 84. The bearing assembly heat exchanger 66 has the helical recess formed on the outer barrel 52, and the latch assembly heat exchanger helical recess is formed in an upper housing 86 of the latch assembly 46.

Fluid passages 88 at opposite ends of the bearing assembly heat exchanger 66 are in communication with the helical recess formed on the outer barrel 52, the pump assembly 68 and the bearings 44 and spaces 72 about the bearings. Fluid passages 90 at opposite ends of the latch assembly heat exchanger 80 are in communication with the helical recess formed in the upper housing 86 and an external hydraulic power unit with a heat exchanger (described more fully below).

Although the heat exchangers 66, 80 are described herein as comprising a helical recess, other types of heat exchangers could be used instead of, or in addition to, a helical recess. For example, a tortuous path other than a helical path could be used, the heat exchanger flow path could be formed on the sleeves 82, 84, etc. Thus, the scope of this disclosure is not limited to use of any particular type of heat exchanger.

The pump assembly 68 operates in response to rotation of the inner barrel 50 as described above. In this example, a ring gear 92 is secured to the inner barrel 50, so that the ring gear rotates with the inner barrel. The ring gear 92 is operatively engaged with a gear train 94 that translates the ring gear rotation to rotation of a pump gear. When the pump gear is rotated, the lubricant or other fluid is circulated through the bearings 44, spaces 72 and heat exchanger 66 via the fluid passages 88.

Figure 5:
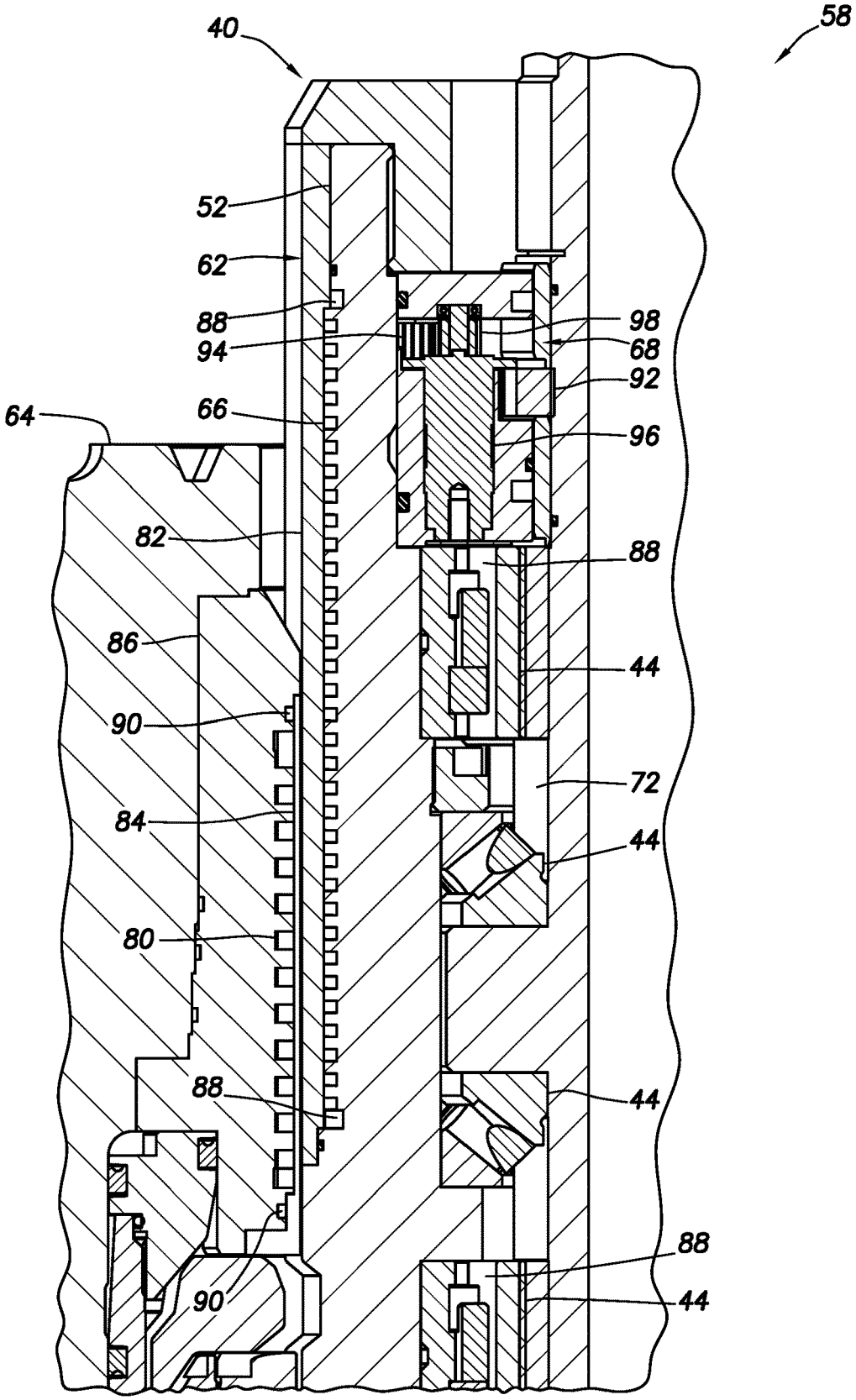
FIG. 5 is a representative cross-sectional view of the heat exchanger and a pump section of the FIG. 3 rotating control device.

Referring additionally now to FIG. 5, another cross-sectional view of the heat exchanger section of the pressure control device 58 is representatively illustrated. In this view, the pump 96 and the pump gear 98 are visible. The pump gear 98 is driven by the gear train 94, due to rotation of the ring gear 92 on the inner barrel 50.

Figure 6:
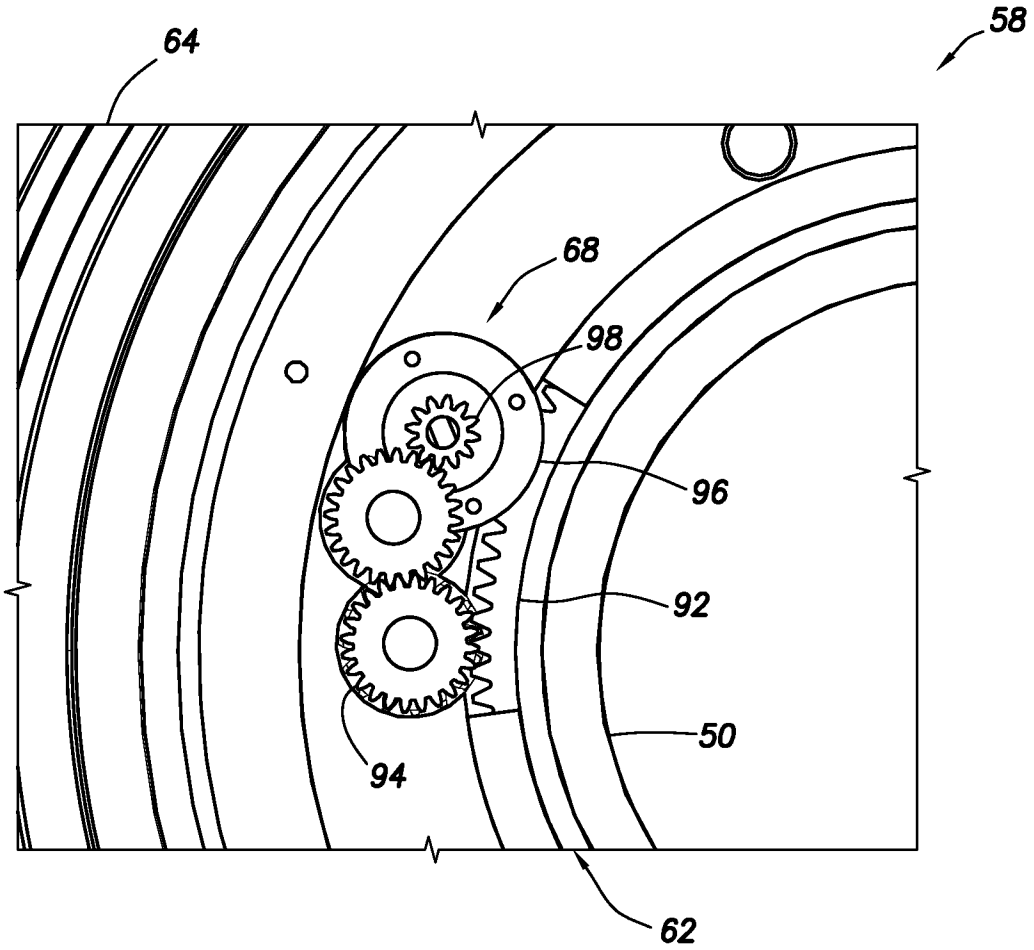
FIG. 6 is a representative top view of a pump gear drive section of the FIG. 3 rotating control device.

Referring additionally now to FIG. 6, a top view of a pump assembly 68 section of the pressure control device 58 is representatively illustrated. In this view, the manner in which the gear train 94 is operatively connected between the ring gear 92 and the pump gear 98 is visible.

Figure 7:
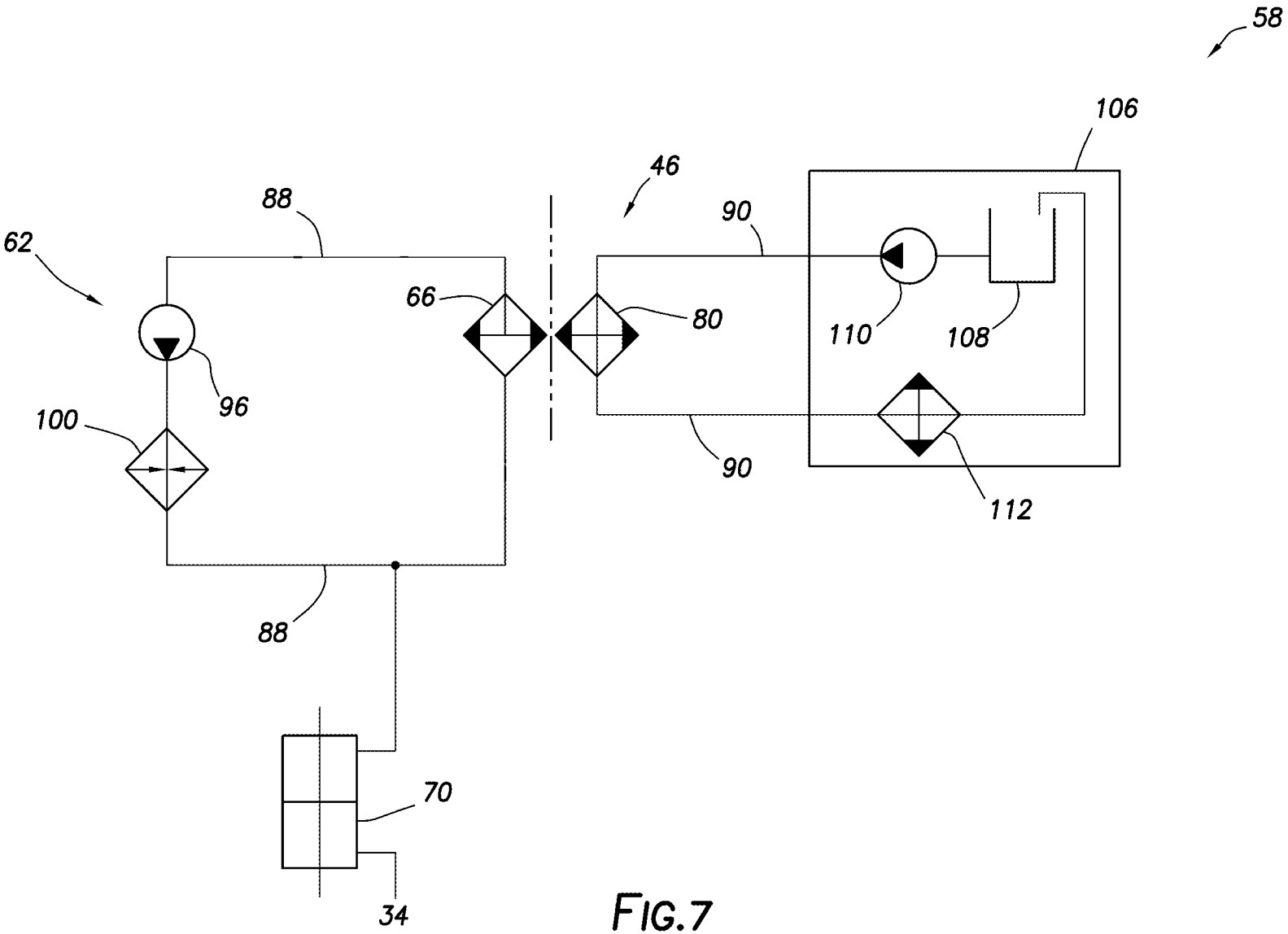
FIG. 7 is a representative hydraulic circuit diagram for the FIG. 3 rotating control device.

Referring additionally now to FIG. 7, an example of a hydraulic circuit diagram for the FIGS. 3-6 pressure control device 58 is representatively illustrated. It should be understood, however, that other hydraulic circuit designs can be used with the pressure control device 58, and the FIG. 7 hydraulic circuit diagram is somewhat simplified for clarity and ease of description. Therefore, the scope of this disclosure is not limited to any particular details of the FIG. 7 hydraulic circuit diagram, or to any particular features or components of the hydraulic circuit diagram.

As depicted in FIG. 7, the pump 96 is connected to the fluid passages 88, so that the pump can circulate the lubricant or other fluid through the bearings 44, spaces 72 (see FIG. 3) and heat exchanger 66. As indicated at reference numeral 100, heat is transferred to the lubricant or other fluid due to operation of the bearings 44 while the inner barrel 50 is rotating.

The heat exchanger 80 of the latch assembly 46 is positioned adjacent the bearing assembly heat exchanger 66 for efficient transfer of heat from the heat exchanger 66 to the heat exchanger 80. An external hydraulic power unit 106 is connected to the fluid passages 90 in the latch assembly 46, such as, via lines communicating through the outer housing 64 (see FIG. 3).

The hydraulic power unit 106 includes a fluid reservoir 108, a pump 110 and a heat exchanger 112. The pump 110 pumps a fluid (such as, a hydraulic fluid, glycol, etc.) from the reservoir 108 to one of the fluid passages 90 connected to one end of the heat exchanger 80. The fluid passes through the heat exchanger 80 and heat is transferred to the fluid from the other heat exchanger 66.

The heated fluid passes through another fluid passage 90 to the hydraulic power unit heat exchanger 112. Heat is transferred from the fluid in the heat exchanger 112, for example, to the surrounding environment. The cooled fluid is then flowed back to the reservoir 108.

Thus, the heat transferred from the bearings 44 to the fluid at 100 is transferred to a location external to the pressure control device 58 using the heat exchangers 66, 80, 112, the pumps 96, 110, the fluid passages 88, 90 and the fluids flowed through the fluid passages. The pump 96 located internal to the bearing assembly 62 and driven by rotation of the inner barrel 50 supports the use of sealed bearings 44 which will not be contaminated with well fluid or debris when the bearing assembly is installed in the outer housing 64. An upper end of the outer housing 64 can be sealed off, for example, with a riser, overshots, upper bell nipples, etc., permitting the rotating control device 40 to operate at higher pressures.

The above disclosure provides to the art a pressure control device 58 for use with a subterranean well. In one example, the pressure control device 58 can include an outer housing 64; a bearing assembly 62 comprising bearings 44 to rotatably support an inner barrel 50 in the outer housing 64, a heat exchanger 66, and fluid passages 88 that communicate between the bearings 44 and the heat exchanger 66; and a latch assembly 46 configured to releasably secure the bearing assembly 62 in the outer housing 64. The latch assembly 46 includes a heat exchanger 80 configured to exchange heat with the bearing assembly heat exchanger 66.

The bearing assembly 62 may include a pump 96 in communication with the fluid passages 66. The pump 96 may be configured to be driven by rotation of the inner barrel 50. A gear train 94 may be connected between the pump 96 and a ring gear 92 secured to the inner barrel 50.

A hydraulic power unit 106 may be externally connected to the outer housing 64, and the hydraulic power unit 106 may be in communication with the latch assembly heat exchanger 80. The hydraulic power unit 106 may include a heat exchanger 112. The hydraulic power unit 106 may include a pump 110 configured to flow a fluid through the latch assembly heat exchanger 80 and the hydraulic power unit heat exchanger 112.

Also provided to the art by the above disclosure is a pressure control device 58 comprising: an outer housing 64; and a bearing assembly 62 comprising bearings 44 to rotatably support an inner barrel 50 in the outer housing 64, fluid passages 88 that communicate with space 72 adjacent the bearings 44, a pump 96 in communication with the fluid passages 88, and a gear train 94 connected between the pump 96 and a ring gear 92 secured to the inner barrel 50.

The pump 96 may be configured to be driven by rotation of the inner barrel 50. The bearing assembly 62 may include a heat exchanger 66 in communication with the fluid passages 88. The pressure control device 58 may include a latch assembly 46 configured to releasably secure the bearing assembly 62 in the outer housing 64, the latch assembly 46 comprising a heat exchanger 80 configured to exchange heat with the bearing assembly heat exchanger 66.

Another pressure control device 58 described above can comprise an outer housing 64; a bearing assembly 62 comprising bearings 44 to rotatably support an inner barrel 50 in the outer housing 64, a heat exchanger 66, fluid passages 88 that communicate between the bearings 44 and the heat exchanger 66, and a pump 96 in communication with the fluid passages 88; and a latch assembly 46 configured to releasably secure the bearing assembly 62 in the outer housing 64, the latch assembly 46 comprising a heat exchanger 80 configured to exchange heat with the bearing assembly heat exchanger 66.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A pressure control device for use with a subterranean well, the pressure control device comprising:

an outer housing;

a bearing assembly comprising bearings to rotatably support an inner barrel in the outer housing, a heat exchanger, fluid passages that communicate between the bearings and the heat exchanger, and a pump in communication with the fluid passages, in which the pump is configured to be driven by rotation of the inner barrel; and a latch assembly configured to releasably secure the bearing assembly in the outer housing, the latch assembly comprising a heat exchanger configured to exchange heat with the bearing assembly heat exchanger.

2. The pressure control device of claim 1, in which a gear train is connected between the pump and a ring gear secured to the inner barrel.

3. The pressure control device of claim 1, in which a hydraulic power unit is externally connected to the outer housing, and the hydraulic power unit is in communication with the latch assembly heat exchanger.

4. The pressure control device of claim 3, in which the hydraulic power unit comprises a heat exchanger.

5. The pressure control device of claim 4, in which the hydraulic power unit comprises a pump configured to flow a fluid through the latch assembly heat exchanger and the hydraulic power unit heat exchanger.

6. A pressure control device for use with a subterranean well, the pressure control device comprising:

an outer housing; and a bearing assembly comprising bearings to rotatably support an inner barrel in the outer housing, fluid passages that communicate with space adjacent the bearings, a pump in communication with the fluid passages, and a gear train connected between the pump and a ring gear secured to the inner barrel.

7. The pressure control device of claim 6, in which the pump is configured to be driven by rotation of the inner barrel.

8. The pressure control device of claim 6, in which the bearing assembly further comprises a heat exchanger in communication with the fluid passages.

9. The pressure control device of claim 8, further comprising a latch assembly configured to releasably secure the bearing assembly in the outer housing, the latch assembly comprising a heat exchanger configured to exchange heat with the bearing assembly heat exchanger.

10. The pressure control device of claim 9, in which a hydraulic power unit is externally connected to the outer housing, and the hydraulic power unit is in communication with the latch assembly heat exchanger.

11. The pressure control device of claim 10, in which the hydraulic power unit comprises a heat exchanger.

12. The pressure control device of claim 11, in which the hydraulic power unit comprises a pump configured to flow a fluid through the latch assembly heat exchanger and the hydraulic power unit heat exchanger.

13. A pressure control device for use with a subterranean well, the pressure control device comprising:

an outer housing comprising a first heat exchanger, in which a first pump circulates a first fluid through the first heat exchanger;

a bearing assembly comprising bearings to rotatably support an inner barrel in the outer housing, a second heat exchanger, fluid passages that communicate between the bearings and the second heat exchanger, and a second pump in communication with the fluid passages, in which the second pump circulates a second fluid through the fluid passages and the second heat exchanger; and a latch assembly configured to releasably secure the bearing assembly in the outer housing, in which, when the bearing assembly is secured within the outer housing, the second heat exchanger is positioned adjacent the first heat exchanger, whereby heat is transferred from the second heat exchanger to the first heat exchanger.

14. The pressure control device of claim 13, in which the second pump is configured to be driven by rotation of the inner barrel.

15. The pressure control device of claim 14, in which a gear train is connected between the second pump and a ring gear secured to the inner barrel.

16. The pressure control device of claim 13, in which the first pump is externally connected to the outer housing.

17. The pressure control device of claim 13, in which the first pump circulates the first fluid through a third heat exchanger.

* * * * *